US005883473A

United States Patent [19]

Li et al.

[11] Patent Number: 5,883,473

[45] Date of Patent: Mar. 16, 1999

[54] ELECTRONIC BALLAST WITH INVERTER PROTECTION CIRCUIT

[75] Inventors: Edward Li, Roselle; Sameer Sodhi, Palatine, both of Ill.

[73] Assignee: Motorola Inc., Schaumburg, Ill.

[21] Appl. No.: 984,444

[22] Filed: Dec. 3, 1997

[51] Int. Cl.[6] ..... H05B 41/14

[52] U.S. Cl. ..... 315/225; 315/209 R; 315/219; 315/291; 315/307; 315/308; 315/DIG. 5; 315/DIG. 7; 315/224

[58] Field of Search ..... 315/DIG. 5, DIG. 7, 315/225, 291, 307, 219, 308, 119, 209 R, 224

[56] References Cited

U.S. PATENT DOCUMENTS 5,089,753 2/1992 Mattas ..... 315/324
5,140,229 8/1992 Yagi et al. ..... 315/307
5,650,694 7/1997 Jayaraman et al. ..... 315/225
5,739,645 4/1998 Xia et al. ..... 315/307

*Primary Examiner*—Don Wong
*Assistant Examiner*—Wilson Lee
*Attorney, Agent, or Firm*—Kenneth D. Labudda; Gary J. Cunningham

[57] ABSTRACT

An electronic ballast (10) comprising an AC-to-DC converter (100), an inverter (200), an output circuit (400), a high-voltage detection circuit (500), and a no-load detection suit (600). The inverter (200) includes an inverter control circuit (300) that monitors the lamp(s) via the high-voltage detection circuit (500) and the no-load detection circuit (600), and that terminates inverter switching in response to various lamp-fault conditions such as "diode-mode" behavior. Inverter control circuit (300) also provides for automatic ignition of a replaced lamp and may be economically implemented as a single integrated circuit.

31 Claims, 6 Drawing Sheets

ELECTRONIC BALLAST WITH INVERTER PROTECTION CIRCUIT

FIELD OF THE INVENTION

The present invention relates to the general subject of circuits for powering gas discharge lamps and, in particular, to an electronic ballast with an inverter protection circuit.

BACKGROUND OF THE INVENTION

Electronic ballasts typically include an inverter that provides high frequency current for efficiently powering gas discharge lamps. Inverters are generally classified according to switching topology (e.g., half-bridge or push-pull) and the method used to control commutation of the inverter switches (e.g., driven or self-oscillating). In many types of electronic ballasts, the inverter provides a square wave output voltage. The square wave output voltage is processed by a resonant output circuit that provides high voltage for igniting the lamps and a magnitude-limited current for powering the lamps.

When the lamps fail, are removed, or otherwise cease to operate in a normal fashion, it is highly desirable that the inverter be shut down or at least shifted to a different mode of operation. This is necessary in order to minimize power dissipation, reduce heating in the ballast, and protect the inverter transistors from damage due to excessive voltage, current, and heat. Circuits that shut down or alter the operation of the inverter in response to lamp removal or failure are customarily referred to as inverter protection circuits.

Several existing types of protection circuits utilize a current path through the lamp filaments to detect lamp removal or failure. This approach alone is inadequate for those situations in which a lamp fails to operate in a normal manner, but its filaments remain intact, such as what occurs with "degassed" and "diode mode" lamps. Furthermore, if multiple lamps are present, and if a single current path through the filaments of all the lamps is used, the inverter may be shut down even if only one filament of a given lamp fails but the remaining lamps are operational and with their filaments intact. This is unnecessary and undesirable, since it is preferred to have the inverter continue to operate so that the remaining operational lamps may continue to provide illumination, thus obviating any urgent need for replacement of the single failed lamp.

Many existing inverter protection circuits respond to a lamp fault condition by shutting down the inverter and then keeping the inverter off for as long as power is applied to the ballast. With such protection circuits, after replacement of a failed lamp with an operational lamp, it is required that power to the ballast be turned off and then on again (i.e., "cycled") in order to effect ignition and powering of the lamps in the fixture which was relamped. This limitation poses a considerable inconvenience in many environments, such as offices and factories, in which a large number of ballasts are often connected in the same branch circuit. In such environments, it is often necessary to momentarily interrupt the lighting in a large area in order to restore desired operation to even a single lighting fixture after one or more of its lamps are replaced.

It is therefore apparent that a need exists for an inverter protection circuit that provides protection of the inverter switches and other ballast components under various lamp failure modes, such as lamp removal or a degassed lamp, and that also allows the inverter to continue to operate when at least one operational lamp is present and when the failed lamps present no danger to the inverter. In addition, a need exists for a relamping circuit that, following lamp replacement, provides ignition and powering of the lamps in an automatic manner and without any need for cycling the power to the ballast.

A number of protection circuits attempt to detect diode-mode behavior of a lamp by monitoring the voltage across one or more components of the resonant output circuit. For example, a common approach is to unidirectionally monitor the voltage across the resonant capacitor, wherein an abnormally high positive voltage is interpreted as an indication of diode-mode behavior. A drawback of this approach is that it fails to detect those cases in which a diode-mode lamp causes a negative overvoltage condition, but not a positive overvoltage condition, across the resonant capacitor. Thus, a need exists for a detection circuit that more completely provides detection of diode-mode behavior by monitoring the output circuit for both positive and negative overvoltage conditions.

Many existing protection circuits require a large number of discrete components. This makes the ballast physically large, materially expensive, and difficult to manufacture. It is highly desirable to have a protection circuit that employs only a modest amount of discrete circuitry and that incorporates the greater portion of the protection circuitry in an inverter control circuit that is suited for implementation as an integrated circuit. Such a protection circuit would significantly enhance the reliability and manufacturability of the resulting ballast and would thus represent a considerable advance over the prior art.

DETAILED DESCRIPTION OF THE PREFERRED EMBODIMENTS

Figure 1:
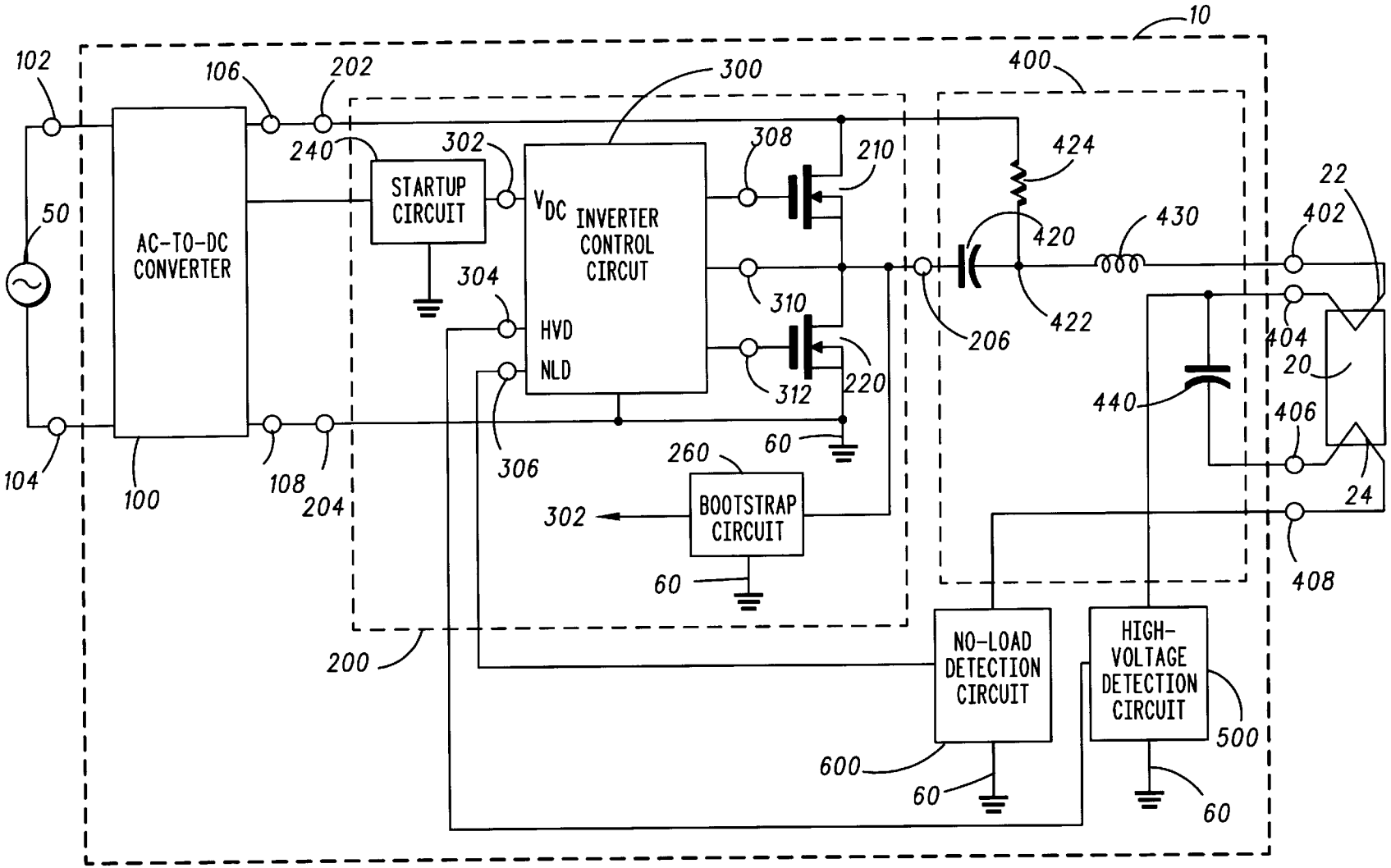
FIG. 1 describes an electronic ballast with an inverter protection circuit, in accordance with the present invention.

An electronic ballast 10 for powering a gas discharge lamp 20 is described in FIG. 1. Ballast 10 comprises an alternating current (AC) to direct current (DC) converter 100, an inverter 200, an output circuit 400, a high-voltage detection circuit 500, an a no-load detection circuit 600.

AC-to-DC converter 100 includes a pair of input connections 102,104 for receiving a source of alternating current 50, and a pair of output connections 106,108. Inverter 200 comprises first and second input terminals 202,204, an output terminal 206, a first inverter switch 210, a second inverter switch 220, an inverter control circuit 300, a startup circuit 240, and a bootstrap circuit 260. First and second input terminals 202,204 are coupled to the output connections 106,108 of AC-to-DC converter 100. Second input terminal 204 is also coupled to a circuit ground node 60. Inverter switches 210,220 may be implemented using any of a number of controllable power switching devices, such as field-effect transistors (shown in FIG. 1) or bipolar junction transistors. Inverter control circuit 300 includes a DC supply input 302 for receiving operating power, a first drive output 308 coupled to first inverter switch 210, a second drive output 312 coupled to second inverter switch 220, a high-voltage detect (HVD) input 304, and a no-load detect (NLD) input 306. Preferably, inverter control circuit 300 also includes an auxiliary output 310 coupled to the junction of inverter switches 210,220 at inverter output terminal 206. Startup circuit 240, coupled between AC-to-DC converter 100 and DC supply input 302, is operable to provide power for initiating operation of inverter control circuit 300 following initial application of AC power to ballast 10. Bootstrap circuit 260, coupled between inverter output terminal 206 and DC supply input 302, provide steady-state operating power to inverter control circuit 300.

As described in FIG. 1, output circuit 400 comprises a set of output wires 402,404,406,408, a direct current (DC) blocking capacitor 420, a direct current (DC) path resistor 424, a resonant inductor 430, and a resonant capacitor 440. Output wires 402,404,406,408 are adapted to being coupled to a gas discharge lamp 20. More specifically, first output wire 402 is coupleable to second output wire 404 through a first filament 22 of lamp 20, while third output wire 406 is coupleable to fourth output wire 408 through a second filament 24 of lamp 20. DC blocking capacitor 420 is coupled between inverter output terminal 206 and a first node 422. DC path resistor 424 is coupled between first input terminal 202 of inverter 200 and first node 422. The function of DC path resistor 424 is to provide a circuit path whereby a DC current is allowed to flow even when inverter 200 is off. As will be explained below, this DC current plays an important part in allowing ballast 10 to automatically ignite and operate a replaced lamp. Resonant inductor 430 is coupled between first node 422 and first output wire 402. Resonant capacitor 440 is coupled between second output wire 404 and third output wire 406. Output circuit 400 is configured as a series resonant circuit that provides a high voltage for igniting lamp 20 and a magnitude-limited current for steady-state powering of lamp 20. Additionally, output circuit 400 is commonly referred to as a "direct-coupled" arrangement, in that physical disconnection of lamp 20 from output wires 402, . . . ,408, or failure of either of the lamp filaments 22,24, effectively disconnects resonant capacitor 440 from the rest of output circuit 400. This type of output wire arrangement is common in electronic ballasts used in a number of European countries.

Referring again to FIG. 1, high-voltage detection circuit 500 is coupled between second output wire 404 and HVD input 304 of inverter control circuit 300. No-load detection circuit 600 is coupled between fourth output wire 408 and NLD input 306 of inverter control circuit 300. Functionally, high-voltage detection circuit 500 and no-load detection circuit 600 monitor lamp 20 and convey information regarding operation of lamp 20 to inverter control circuit 300. This information includes whether or not lamp 20 is indeed present and properly connected to output wires 402, . . . ,408, and whether or not lamp 20 is operating in a normal manner.

Using the information provided by high-voltage detection circuit 500 and no-load detection circuit 600, inverter control circuit 300 is operable to: (1) provide an ignition period following initial application of electrical power to ballast 10, wherein, regardless of the signals applied to the HVD and NLD inputs 304,306, inverter switches 210,220 are switched on and off in a complementary fashion (i.e., inverter switch 210 is on while inverter switch 220 is off, and vice-versa) for at least a first predetermined period of time; (2) continue to provide complementary switching of inverter switches 210, 220 as long as lamp 20 is operating normally; (3) terminate switching of inverter switches 210,220 in response to various lamp-fault conditions; and (4) provide a relamping period wherein complementary switching of inverter switches 210,220 is automatically resumed for at least a second predetermined period of time following replacement of a defective or failed lamp with a new lamp. The various lamp-fault conditions that cause inverter control circuit 300 to terminate switching of inverter switches 210,220 include: (i) failure of lamp 20 to ignite and operate normally within the ignition period; (ii) removal (i.e., physical disconnection) of lamp 20; (iii) failure of lamp 20 to conduct current in a substantially normal fashion (such as what occurs with a degassed or diode-mode lamp); and (iv) opening of either one or both filaments 22,24 of lamp 20. Additionally, inverter control circuit 300 terminates switching of inverter switches 210,220 when, following replacement of a failed lamp with a new lamp, the new lamp fails to ignite and operate normally within the relamping period.

Figure 2:
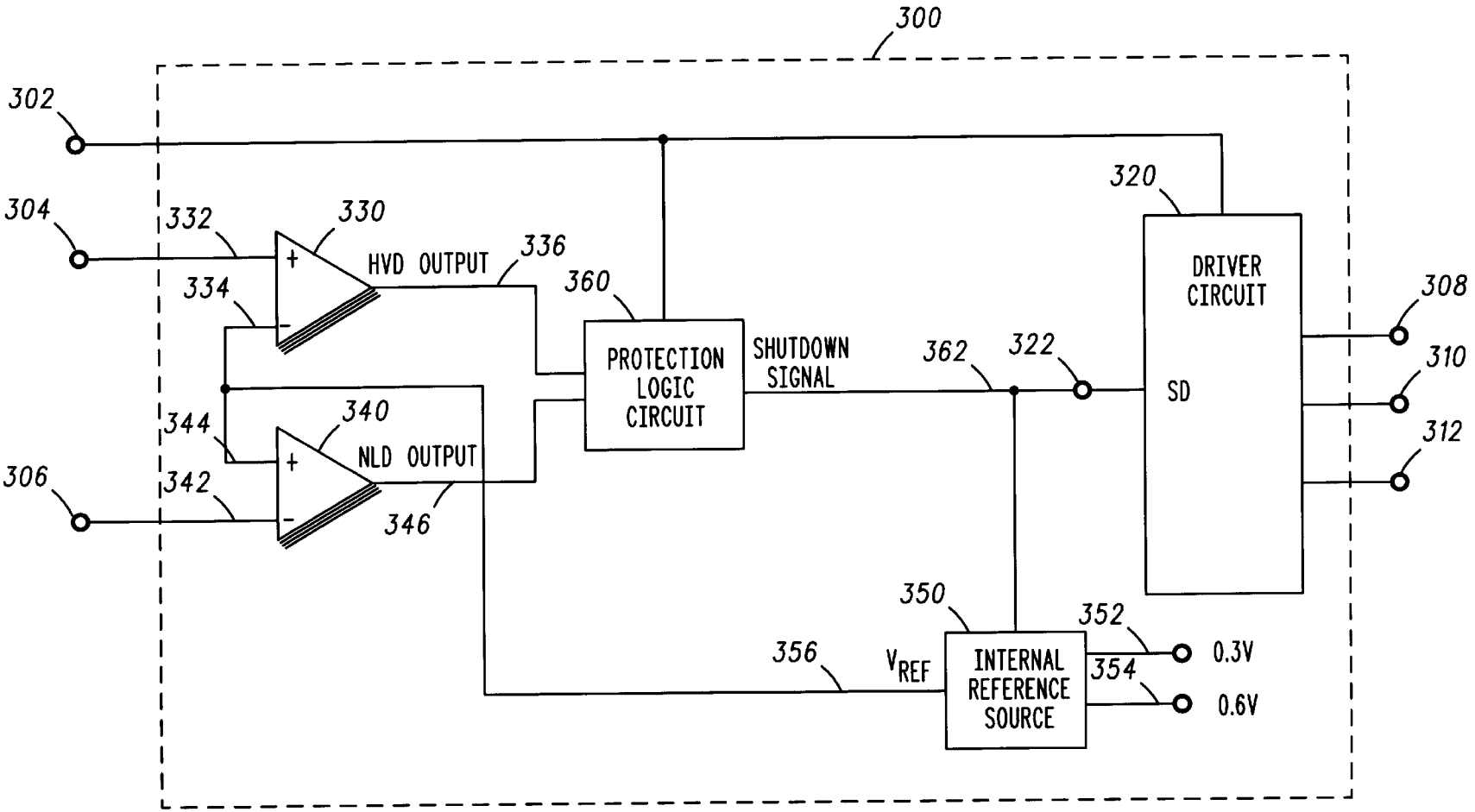
FIG. 2 describes an inverter control circuit, in accordance with a preferred embodiment of the present invention.

Turning now to FIG. 2, in a preferred embodiment of ballast 10, inverter control circuit 300 further includes a driver circuit 320, an internal reference source 350 for providing a reference voltage 356 ($V_{REF}$), a first comparator 330, a second comparator 340, and a protection logic circuit 360.

Driver circuit 320 is coupled to first and second drive outputs 308,312, and includes a shutdown input 322. As shown previously with regard to FIG. 1, first and second drive outputs 308,312 are coupled to inverter switches 210,220. If inverter switches 210,220 are to be used in a half-bridge type inverter, driver circuit 320 is further coupled to auxiliary output 310. During operation, driver circuit 320 provides complementary switching of inverter switches 210,220 when a logic "0" is applied to shutdown input 322, and terminates switching of inverter switches 210,220 when a logic "1" is applied to shutdown input 322. Driver circuit 320 may be implemented using circuitry like that which is employed in existing high-side driver devices, such as the IR2151 high-side driver integrated circuit manufactured by International Rectifier.

First comparator 330 has a non-inverting input 332 coupled to HVD input 304, an inverting input 334 coupled to internal reference source 350, and an HVD output 336. First comparator 330 provides a logic "1" at HVD output 336 when the voltage at HVD input 304 exceeds the reference voltage, $V_{REF}$, and a logic "0" at HVD output 336 when the voltage at HVD input 304 is less than $V_{REF}$. Second comparator 340 has an inverting input 342 coupled to NLD input 306, a non-inverting input 344 coupled to internal reference source 350, and an NLD output 346. Second comparator 340 provides a logic "0" at NLD output 346 when the voltage at NLD input 306 exceeds $V_{REF}$, and a logic "1" at NLD output 346 when the voltage at NLD input 306 is less than $V_{REF}$.

Protection logic circuit 360, which is preferably realized using conventional logic gates and flip-flops, receives HVD and NLD outputs 336,346 from comparators 330,340 and provides a shutdown signal 362 to the shutdown input 322 of driver circuit 320. More specifically, protection logic circuit 360 operates in such a way that shutdown signal 362 is a logic "0" for each of the following conditions: (1) during the ignition period following initial application of power to ballast 10; (2) when HVD output 336 is a logic "0" and NLD output 346 is a logic "0"; and (3) when NLD output 346 is a logic "1" and HVD output 336 changes from a logic "0" to a logic "1". Conversely, shutdown signal 362 is a logic "1" for each of the following conditions: (1) when HVD output 336 is a logic "1" (regardless of the value of NLD output 346); and (2) when NLD output 346 is a logic "1" and HVD output 336 is not changing from a logic "0" to a logic "1". As discussed previously, when shutdown signal 362 is a logic "0", driver circuit 320 is allowed to continue providing complementary switching of inverter switches 210, 220. On the other hand, when shutdown signal 362 is a logic "1", driver circuit 320 ceases to provide complementary switching of inverter switches 210,220 and inverter 200 is thus effectively turned off.

As described in FIG. 2, internal reference source 350 provides a reference voltage, $V_{REF}$, that is preferably adjusted in dependence on shutdown signal 362. In one embodiment, $V_{REF}$ is at a first level (e.g., 0.6 volts) when shutdown signal 362 is a logic "0", and at a second level (e.g., 0.3 volts) when shutdown signal 362 is a logic "1". As will be explained in further detail below, having $V_{REF}$ adjustable based on the value of shutdown signal 362 facilitates relamping in a ballast for powering two or more lamps.

Since driver circuit 320, first and second comparators 330,340, internal reference source 350, and protection logic circuit 360 are all relatively low-power circuits, inverter control circuit 300 is very well-suited for implementation as a single integrated circuit. Advantageously, since a considerable portion of the protection circuitry is incorporated within inverter control circuit 300, the number of discrete components in high-voltage detection circuit 500 and no-load detection circuit 600 can be greatly reduced. This results in a lower component count that significantly enhances the reliability and manufacturability of ballast 10.

Figure 3:
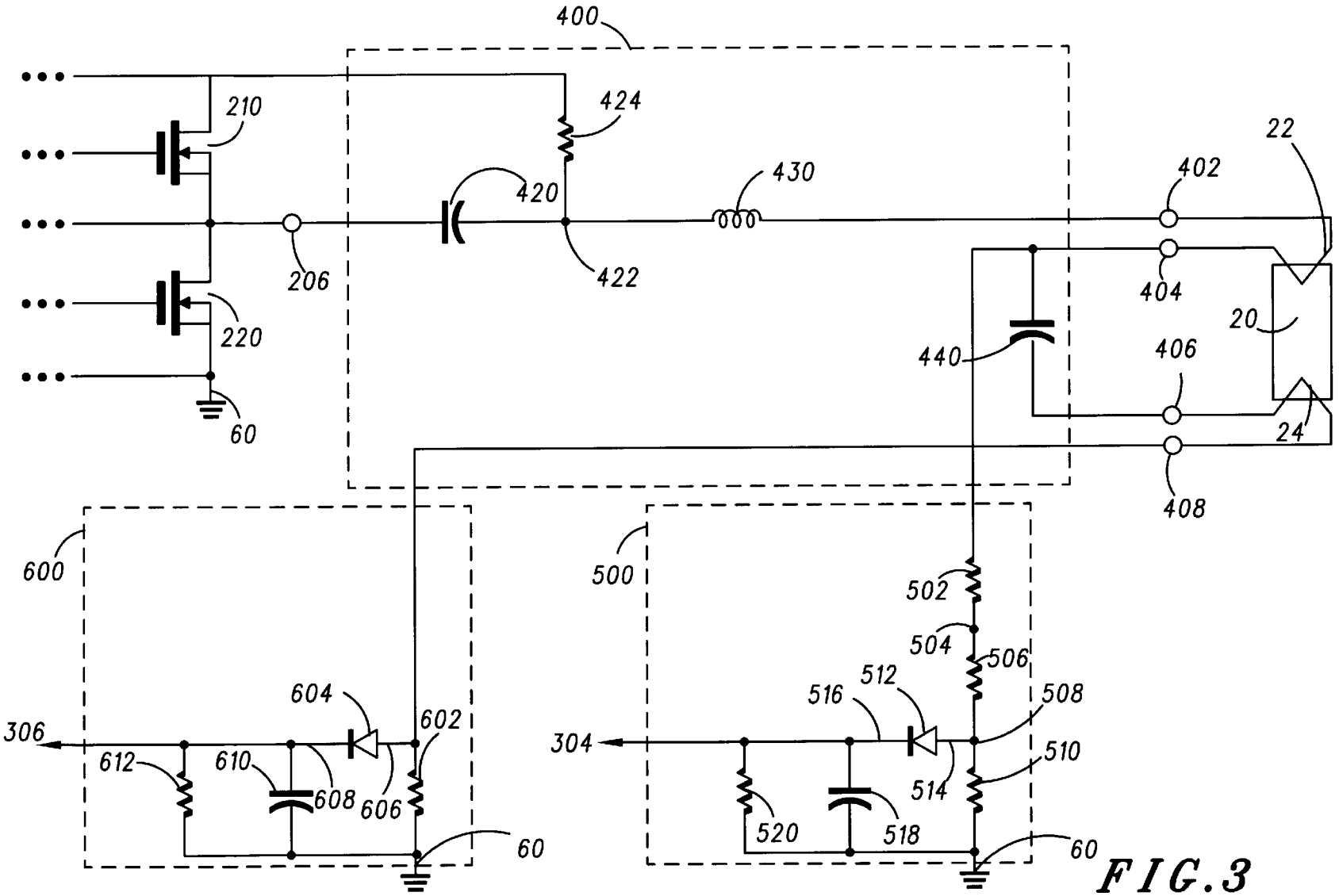
FIG. 3 describes a high-voltage detection circuit and a no-load detection circuit, in accordance with one embodiment of the present invention.

Referring now to FIG. 3, in one embodiment of ballast 10, high-voltage detection circuit 500 comprises a first resistor 502, a second resistor 506, a third resistor 510, a first diode 512, a first capacitor 518, and a fourth resistor 520. First resistor 502 is coupled between second output wire 404 and a second node 504. Second resistor 506 is coupled between second node 504 and a third node 508. Optionally, first and second resistors 502,506 may be replaced by a single resistor. Third resistor 510 is coupled between third node 508 and circuit ground node 60. First diode 512 has an anode 514 coupled to coupled to third node 508 and a cathode 516 coupled to HVD input 304 of inverter control circuit 300. First capacitor 518 and fourth resistor 520 are each coupled between HVD input 304 and circuit ground node 60.

During operation, high-voltage detection circuit 500 monitors the voltage, $V_{OUT}$, at second output wire 404 and provides a voltage at HVD input 304 that is substantially proportional to the peak value of the positive half cycles of $V_{OUT}$. Resistors 502,506,510 function as a voltage divider for transferring a fractional portion of $V_{OUT}$ into first capacitor 518 via first diode 512. First diode 512 serves as a peak-detecting rectifier that allows capacitor 518 to charge up during the positive half cycles of $V_{OUT}$ and prevents capacitor 518 from discharging during the negative half cycles of $V_{OUT}$. Resistor 520 serves as a reset resistor for discharging capacitor 518 so that, following correction of a lamp fault condition, the voltage at HVD input 304 returns to a lower value reflective of the fact that $V_{OUT}$ has returned to a lower, normal value.

When lamp 20 is operating normally, $V_{OUT}$ is relatively low so the voltage at HVD input 304 will be correspondingly low (i.e., a logic "0"). That is, high-voltage detection circuit 500 provides a logic "0" at HVD input 304 in response to each of the following conditions: (i) when lamp 20 is conducting current in a substantially normal fashion; (ii) when lamp 20 is removed; and (iii) when at least one of the lamp filaments 22,24 is open. On the other hand, if lamp 20 begins to operate in a substantially abnormal fashion, $V_{OUT}$ becomes considerably higher than normal; note that, because output circuit 400 is direct-coupled, both lamp filaments 22,24 must be intact and properly connected to output wires 402, . . . ,408 in order for $V_{OUT}$ to become high. Consequently, the voltage at HVD input 304 will be correspondingly high (i.e., a logic "1"). Therefore, high-voltage detection circuit 500 provides a logic "1" at HVD input 304 of inverter control circuit 300 in response to failure of lamp 20 to conduct current in a substantially normal fashion while both of its filaments 22,24 are intact.

Figure 4:
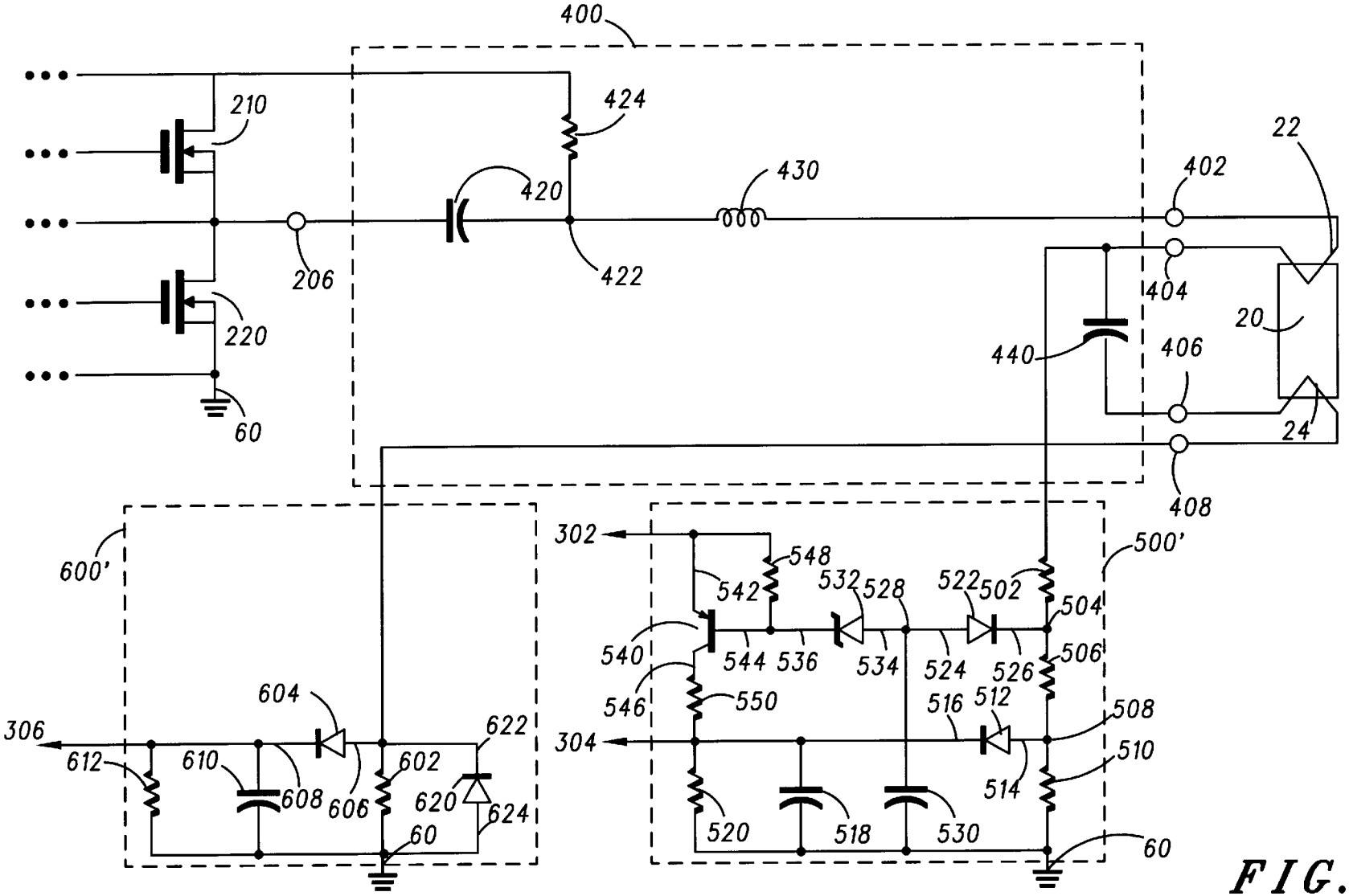
FIG. 4 describes a high-voltage detection circuit and a no-load detection circuit for use in an electronic ballast for powering one gas discharge lamp, in accordance with a preferred embodiment of the present invention.

A preferred embodiment of high voltage detection circuit 500 is described in FIG. 4. Whereas high-voltage detection circuit 500 is operable to detect a positive overvoltage condition at second output wire 404, high-voltage detection circuit 500' includes additional circuitry for detecting both positive and negative overvoltage conditions at second output wire 404. Since a diode-mode lamp may cause either positive or negative overvoltage conditions at second output wire 404, high-voltage detection circuit 500' thus provides more complete and reliable detection of diode-mode behavior in lamp 20. The additional circuitry includes a second diode 522, a second capacitor 530, an electronic switch 540, a fifth resistor 548, a first zener diode 532, and a sixth resistor 550. Second diode 522 has a cathode 526 coupled to second node 504 and an anode 524 coupled to a fourth node 528. Second capacitor 530 is coupled between fourth node 528 and circuit ground node 60. Electronic switch 540, which is preferably implemented as a PNP-type bipolar junction transistor, has an emitter lead 542 coupled to DC supply input 302 of inverter control circuit 300, a collector lead 546, and a base lead 544. Fifth resistor 548 is coupled between base lead 544 and emitter lead 542. First zener diode 532 has an anode 534 coupled to fourth node 528, and a cathode 536 coupled to base lead 544. Sixth resistor 550 is coupled between collector lead 546 and HVD input 304 of inverter control circuit 300.

As previously described, resistors 502,506,510 serve as a voltage divider. By way of diode 512, capacitor 518 takes on a voltage that is roughly proportional to the peak value of the positive half cycles of $V_{OUT}$. Capacitor 530 and diode 522 serve a similar function with regard to the negative half cycles of $V_{OUT}$. That is, capacitor 530 takes on a negative voltage (i.e., with a polarity such that node 528 is at a lower potential than circuit ground node 60) that is representative of the peak value of the negative half cycles of $V_{OUT}$. As long as the negative voltage across capacitor 530 is less than the zener voltage, $V_z$, of zener diode 532, zener diode 532 remains non-conductive and transistor 540 remains off. On the other hand, if $V_{OUT}$ becomes sufficiently large, the voltage across capacitor 530 will become large enough to attempt to exceed $V_z$. When this occurs, zener diode 532 turns on and begins to conduct a positive current from cathode 536 to anode 534. This turns on transistor 540, which then couples the DC voltage (e.g. 15 volts) at DC supply input 302 to HVD input 304, thus providing a voltage at HVD input 304 that amounts to a logic "1". In this way, high-voltage detection circuit 500' monitors output circuit 400 for both negative and positive overvoltage conditions.

Referring back to FIG. 3, no-load detection circuit 600 comprises a seventh resistor 602, a third diode 604, a third capacitor 610, and an eighth resistor 612. Seventh resistor 602 is coupled between fourth output wire 408 and circuit ground node 60. Third diode 604 has an anode 606 coupled to fourth output wire 408 and a cathode 608 coupled to NLD input 306 of inverter control circuit 300. Third capacitor 610 and eighth resistor 612 are each coupled between NLD input 306 and circuit ground node 60.

During operation of ballast 10, no-load detection circuit 600 monitors the "return current" flows into fourth output wire 408 as an indicator of whether or not a lamp with both filaments intact is indeed connected to ballast 10. Resistor 602 serves as a current sensing resistor and has a voltage that is proportional to the return current. Diode 604 and capacitor 610 function as a peak detector in which the voltage provided at NLD input 306 is substantially proportional to the peak value of the positive half-cycles of the return current. Thus, when lamp 20 is present with both filaments 22,24 intact, and the inverter 200 is operating, a voltage equivalent to a logic "1" is provided at NLD input 306. On the other hand, if lamp 20 is removed or if one or both filaments 22,24 become open, no return current will flow through resistor 602 and, consequently, the voltage at NLD input 306 will fall to zero. Resistor 612 serves as a reset resistor for discharging capacitor 610 so that the voltage at NLD input 306 falls to zero within a relatively short period of time following lamp removal or filament failure. Therefore, no-load detection circuit 600 provides a logic "1" at NLD input 306 in response to both lamp filaments 22,24 being intact, and provides a logic "0" at NLD input 306 in response to each of the following conditions: (i) when lamp 20 is removed; and (ii) when at least one of the lamp filaments 22,24 is open.

In a preferred embodiment of no-load detection circuit 600, as described in FIG. 4, no-load detection circuit 600' further includes a fourth diode 620 having an anode 624 coupled to circuit ground node 60 and a cathode coupled to fourth output wire 408. Fourth diode 620 reduces the power dissipation in resistor 602 by providing a bypass path around resistor 602 for the negative-going half cycles of the return current. The positive-going half cycles of the return current continue to flow through resistor 602 as previously described.

Figure 5:
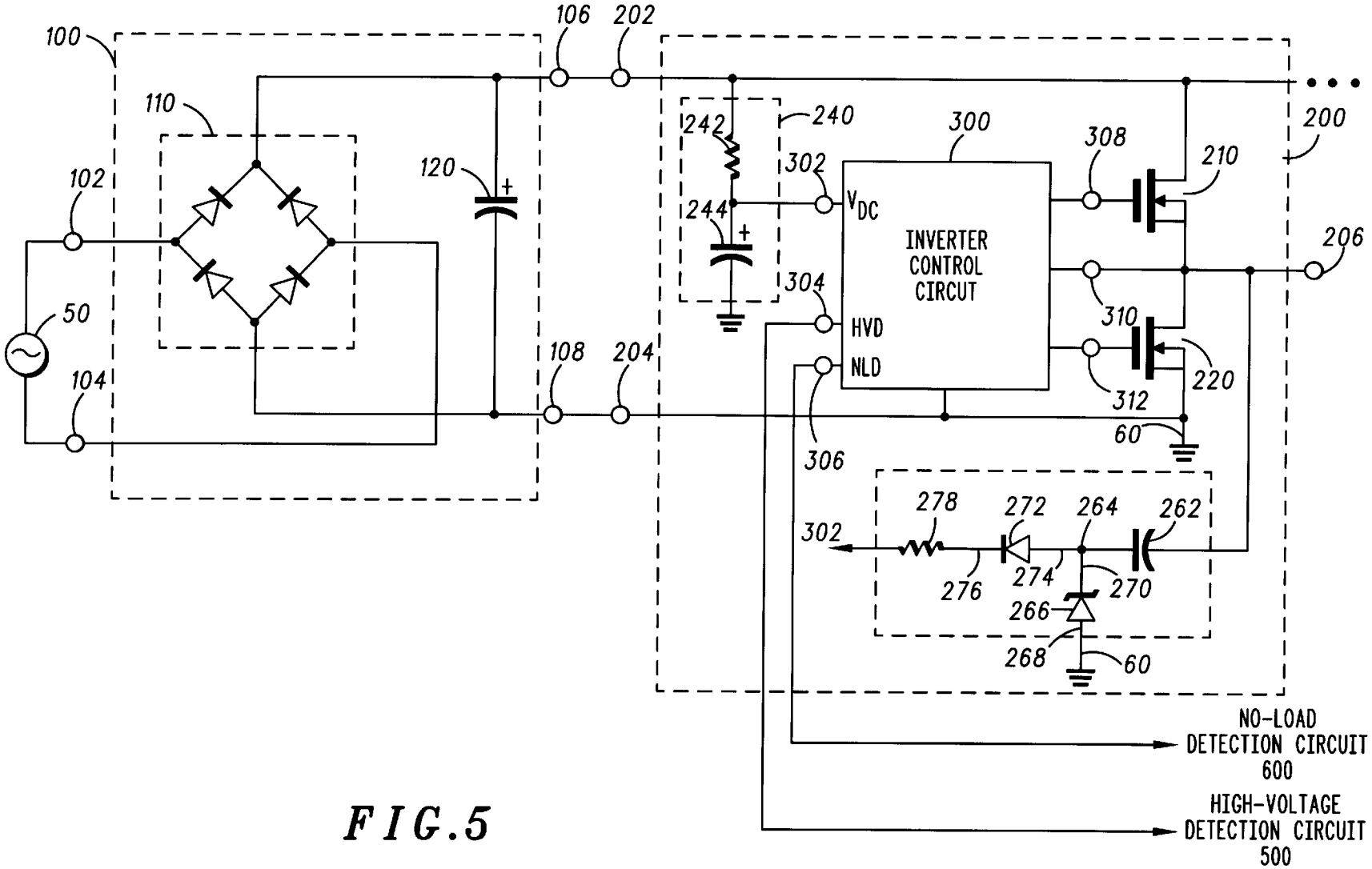
FIG. 5 describes an AC-to-DC converter, a startup circuit, and a bootstrap circuit for use in the ballast illustrated in FIG. 1, in accordance with a preferred embodiment of the present invention.

Turning now to FIG. 5, AC-to-DC converter 100 preferably comprises a full-wave rectifier circuit 110 coupled between input connections 102,104 and output connections 106,108, and a bulk capacitor 120 coupled across output connections 106,108. Rectifier circuit 110 is operable to accept the source of alternating current 50 and to provide a unidirectional voltage between output connections 106,108. Bulk capacitor 120 serves as a filtering capacitor for reducing the amount of AC ripple in the output voltage provided by rectifier circuit 110. AC-to-DC converter may also include a boost converter (not shown), inserted between rectifier circuit 110 and bulk capacitor 120, for providing power factor correction and line regulation.

Preferred implementations for startup circuit 240 and bootstrap circuit 260 are also illustrated in FIG. 5. Startup circuit 240 preferably comprises a pull-down resistor 242 coupled between DC supply input 302 and the first output connection 106 of AC-to-DC converter 100, and a filtering capacitor 244 coupled between DC supply input 302 and circuit ground node 60. Bootstrap circuit 260 comprises a fourth capacitor 262, a second zener diode 266, a fifth diode 272, and (optionally) a current-limiting resistor 278. Fourth capacitor 262 is coupled between inverter output terminal 206 and a fifth node 264, and serves as an AC coupling capacitor for extracting a limited amount of current from inverter output terminal 206. Second zener diode 266, which functions as a voltage regulator that safely limits the amount of voltage provided to DC supply input 302, has a cathode 270 coupled to fifth node 264 and an anode coupled to circuit ground node 60. Fifth diode 272, which serves as a rectifier for transferring only positive-going current to DC supply input 302, has an anode 274 coupled to fifth node 264 and a cathode 276 coupled (either directly or via currentlimiting resistor 278) to DC supply input 302.

When AC power is first applied to the ballast, capacitor 244 is initially uncharged, and inverter control circuit 300 is off and remains off until such time as the voltage at DC supply input 302 reaches a certain level. With AC power applied to the ballast, AC-to-DC converter 100 provides a substantially DC voltage across output connections 106,108, and capacitor 244 begins to charge up due to current delivered to it via resistor 242. Once the voltage across capacitor 244 reaches a certain predetermined level (e.g. 10 volts), inverter control circuit 300 turns on and, using the energy stored in capacitor 244, begins switching of inverter switches 210,220. At this point, the energy stored in capacitor 244 begins to be depleted. However, with inverter switching now taking place, bootstrap circuit 260 begins to operate and provides the steady-state power needed to keep inverter control circuit 300 operating. Capacitor 244 additionally serves as a filtering capacitor for storing energy provided by bootstrap circuit 260. Thus, startup circuit 240 provides a relatively small amount of energy for initially activating inverter control circuit 300, while bootstrap circuit 260 supplies steady-state power for sustaining operation of inverter control circuit 300.

Figure 6:
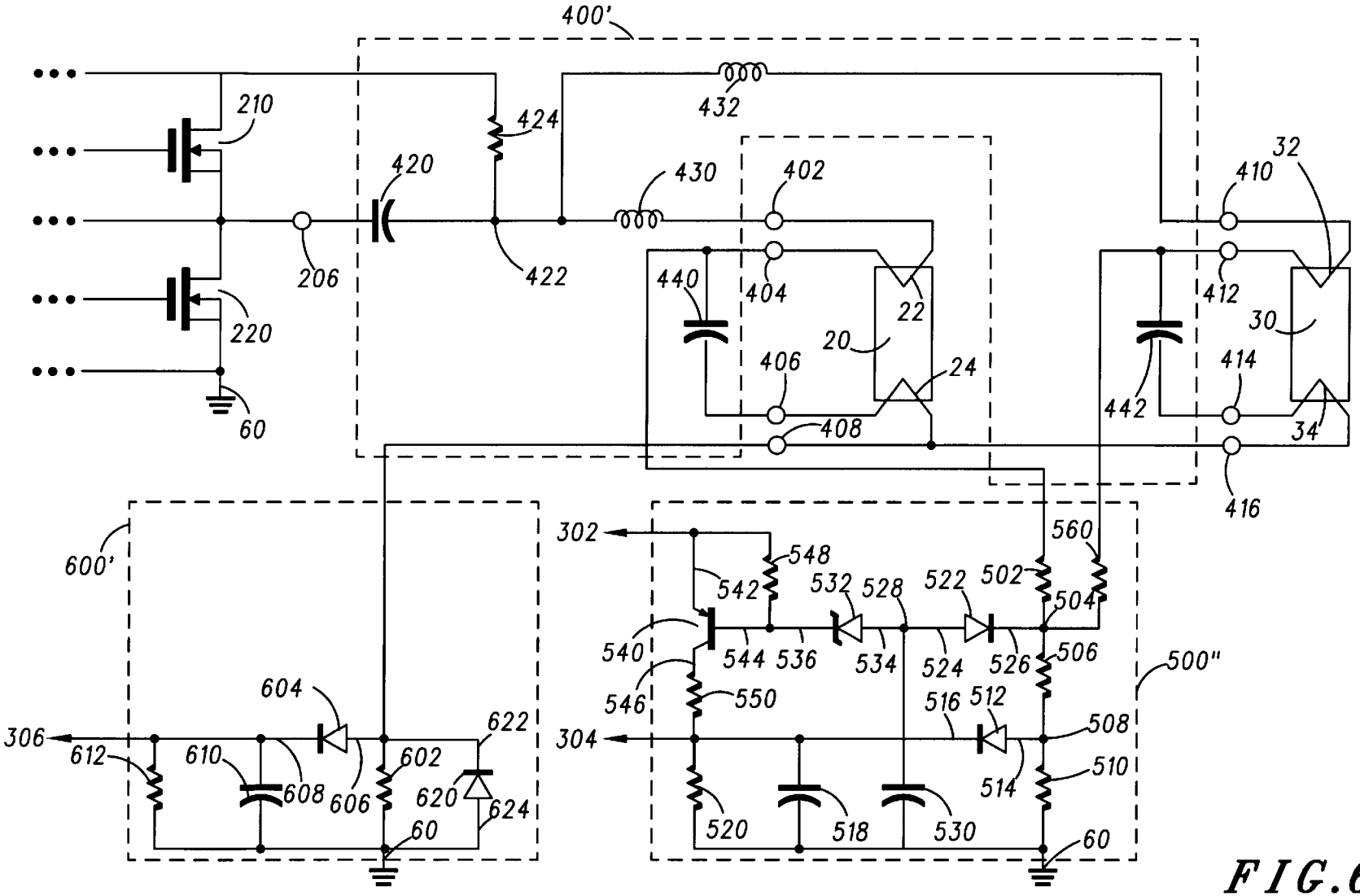
FIG. 6 describes a high-voltage detection circuit and a no-load detection circuit for use in an electronic ballast for powering two gas discharge lamps, in accordance with a preferred embodiment of the present invention.

Appropriate modifications can be made to output circuit 400 and high-voltage detection circuit 500 to render ballast 10 suitable for powering more than one gas discharge lamp. In one such embodiment, as illustrated in FIG. 6, output circuit 400' additionally includes a second resonant inductor 432, a second resonant capacitor 442, and a second set of output wires 410,412,414,416 adapted to being coupled to a second gas discharge lamp 30. Second resonant inductor 432 is coupled between first node 422 and a fifth output wire 410. Second resonant capacitor 442 is coupled between a sixth output wire 412 and a seventh output wire 414. Fifth output wire 410 is coupleable to sixth output wire 412 through a first filament 32 of lamp 30, while seventh output wire 414 is coupleable to eighth output wire 416 through a second filament 34 of lamp 30. Eighth output wire 416 is also coupled to fourth output wire 408.

As described in FIG. 6, high-voltage detection circuit 500" additionally includes a ninth resistor 560 coupled between sixth output wire 412 and second node 504. Ninth resistor 560 is analogous in function to resistor 502 and allows high-voltage detection circuit 500" to monitor for overvoltage due to second lamp 30 becoming degassed or operating in the diode mode. As a result, high-voltage detection circuit 500" is operable to provide a logic "1" at HVD input 304 in response to failure of either one or both of the lamps 20,30 to conduct current in a substantially normal fashion while both of its lamp filaments are intact. On the other hand, high-voltage detection circuit 500" will provide a logic "0" at HVD input 304 in response to each of the following conditions: (1) both lamps conducting current in a substantially normal fashion; (2) removal of both lamps; (3) both lamps having at least one open filament; and (4) each failed lamp (if any) having at least one open filament.

As shown in FIG. 6, the combined return current of both lamps 20,30 flows to circuit ground node 60 via no-load detection circuit 600'. Consequently, and recalling the previous discussion with regard to FIG. 4, no-load detection circuit 600' provides a logic "1" at NLD input 306 as long as the inverter is operating and at least one of the lamps has both of its filaments intact. Conversely, in order for no-load detection circuit 600' to provide a logic "0" at NLD input 306, both lamps must be removed or each lamp must have at least one open filament. For example, if lamp 20 is removed, while lamp 30 remains and operates normally with both filaments 32,34 intact, a nonzero return current is still provided to no-load detection circuit 600', with the result that a logic "1" is provided at NLD input 306. Consequently, inverter control circuit 300 will continue to provide switching of the inverter switches since removal of lamp 20 presents no danger to continued safe operation of the inverter as long as lamp 30 continues to operate normally. On the other hand, if either lamp fails to conduct current in a normal manner, but both of its filaments remain intact (i.e., such as what may occur with a degassed or diode-mode lamp), no-load detection circuit 600' will provide a logic "1" at NLD input 306. However, high-voltage detection circuit 500" will provide a logic "1" at HVD input 304. Consequently, inverter control circuit 300 will terminate inverter switching, regardless of the condition of the other lamp, in order to protect the inverter and output circuit 400' from almost certain damage. In this way, ballast 10 provides a high degree of protection for the inverter under a number of lamp failure modes, yet accommodates "parallel" operation by which the remaining "good" lamp is allowed to continue to operate, and thus provide useful illumination, if the "problem" lamps are either (1) removed; or (2) failed, with at least one filament.

The detailed operation of ballast 10 under various lamp fault conditions is now explained with reference to FIGS. 2 and 6 as follows.

When both lamps 20,30 are present and operating normally with their filaments intact, a logic "0" is provided at HVD input 304 and a logic "1" is provided at NLD input 306. Stated differently, the voltage at HVD input 304 is low (e.g., 0.4 volts) and the voltage at NLD input 306 is high (e.g., 2.4 volts). During this time, since shutdown signal 362 is a logic "0"the reference voltage $V_{REF}$ provided by internal reference source 350 is at its first level (e.g., 0.6 volts). Thus, HVD output 336 is a logic "0" and NLD output 346 is a logic "0", so shutdown signal 362 remains a logic "0" and driver circuit 320 continues to provide complementary switching of inverter switches 210,220.

If lamp 20 is removed while lamp 30 remains connected to the ballast with both of its filaments 32,34 intact, capacitor 440 is disconnected from the rest of output circuit 400. Consequently, the voltage at HVD input 304 remains low, and actually decreases (e.g., to 0.2 volts) since current is no longer supplied to high-voltage detection circuit 500 via resistor 502. The voltage at NLD input 306 similarly decreases (e.g., to 1.2 volts) since the return current is now about half of what it was when both lamps 20,30 were present and operating. Since HVD input 304 is still a logic "0" and NLD input 306 is still a logic "1", inverter control circuit 300 continues to provide swtiching of the inverter switches, in spite of removal of lamp 20. Thus, ballast 10 provides so-called "parallel" operation of two or more lamps.

If both lamps 20,30 are removed, HVD input 304 again remains low due to no current being provided to high voltage detection circuit 500". Since the return current is now zero, NLD input 306 goes to zero. Consequently, NLD output 346 from comparator 340 becomes a logic "1" and, in response, protection logic circuit 360 causes shutdown signal 362 to become a logic "1". This turns off driver circuit 320, thereby terminating switching of inverter switches 210,220. With shutdown signal 362 now a logic "1", internal reference source 350 changes $V_{REF}$ from its first level (e.g., 0.6 volts) to its second level (e.g., 0.3 volts), where it remains as long as shutdown signal 362 is a logic "1".

Now, if one of the lamps (e.g., lamp 20) is reinserted and at least its upper filament (e.g., filament 22) is intact, a DC current flows through DC path resistor 424, first resonant inductor 430, first filament 22, and into high-voltage detection circuit 500" via resistor 502. This DC current charges capacitor 518 and causes the voltage at HVD input 304 to momentarily go high (e.g., 0.4 volts peak). Because the inverter is still off, no return current flows into no-load detection circuit 600' and the voltage at NLD input 306 remains approximately zero. Consequently, NLD output 346 of comparator 340 is a logic "1". With HVD input 304 at a momentarily high value (e.g., 0.4 volts), and with $V_{REF}$ at its second, lower level (e.g., 0.3 volts), the HVD output 336 of comparator 330 goes to a logic "1"; note that this would not be the case if $V_{REF}$ had been allowed to remain at its first level (e.g., 0.6 volts), in which case HVD output 336 would remain a logic "0". As previously explained, in response to HVD output 336 changing from a logic "0" to a logic "1" while NLD output is a logic "1", protection logic circuit 360 then changes shutdown signal 362 to a logic "0". This activates driver circuit 320, which then begins switching of inverter switches 210,220. With inverter switching now taking place, a high voltage soon develops across resonant capacitor 440 to ignite lamp 20. As long as lamp 20 ignites and begins to operate in a normal manner within a predetermined period of time (e.g., 500 milliseconds), shutdown signal 362 will remain a logic "0" and the inverter will continue to operate and provide power to lamp 20. In this way, ballast 10 provides for automatic ignition and operation of a replaced lamp following shutdown of the inverter due to a lamp fault condition.

If one of the lamps (e.g., lamp 30) becomes degassed or exhibits "diode-mode" behavior, the voltage across its respective resonant capacitor (e.g., capacitor 442) increases and causes the voltage at HVD input 304 to increase to the point of representing a logic "1". In response to such a condition, inverter control circuit 300 terminates inverter switching, even though the remaining lamp may be "good". This is necessary in order to protect the ballast from otherwise certain damage arising from overvoltage in output circuit 400'. In this case, the defective lamp (e.g., lamp 30) must be removed and replaced with an operational lamp in order for inverter protection circuit 300 to resume inverter switching.

If each of the lamps 20,30 develops at least one open filament (e.g., filaments 22,34 become open), no return current is provided to no-load detection circuit 600'. Consequently, the voltage at NLD input 306 goes to zero. Because each lamp 20,30 has at least one open filament. resonant capacitors 440,442 are effectively disconnected from the rest of output circuit 400', so no harmful overvoltage condition can develop in output circuit 400'. Nevertheless, inverter control circuit 300 responds to this no-load condition by terminating inverter switching, thus preventing needless power dissipation in inverter switches 210,220.

Although the present invention has been described with reference to certain preferred embodiments, numerous modifications and variations can be made by those skilled in the art without departing from the novel spirit and scope of this invention.

What is claimed is:

1. An electronic ballast for powering a gas discharge lamp, comprising:

an AC-to-DC converter having a pair of input connections adapted to receive a source of alternating current, and a pair of output connections;

an inverter, comprising:

first and second input terminals coupled to the output connections of the AC-to-DC converter, wherein the second input terminal is coupled to a circuit ground node;

an inverter output terminal;

a first inverter switch coupled between the first input terminal and the inverter output terminal;

a second inverter switch coupled between the inverter output terminal and the circuit ground node;

an inverter control circuit, comprising:

a DC supply input;

a first drive output coupled to the first inverter switch;

a second drive output coupled to the second inverter switch;

a high-voltage detect (HVD) input; and a no-load detect (NLD) input;

a startup circuit coupled between the AC-to-DC converter and the DC supply input of the inverter control circuit, the startup circuit being operable to provide power for initiating operation of the inverter control circuit; and a bootstrap circuit coupled between the inverter output terminal and the DC supply input of the inverter control circuit, the bootstrap circuit being operable to provide steady-state operating power to the inverter control circuit;

an output circuit, comprising:

a set of output wires comprising first, second, third, and fourth output wires adapted to being coupled to the gas discharge lamp, wherein the first output wire is coupleable to the second output wire through a first filament of the lamp, and the third output wire is coupleable to the fourth output wire through a second filament of the lamp;

a DC blocking capacitor coupled between the inverter output terminal and a first node;

a DC path resistor coupled between the first input terminal of the inverter and the first node;

a resonant inductor coupled between the first node and the first output wire; and a resonant capacitor coupled between the second and third output wires;

a high-voltage detection circuit coupled between the second output wire and the HVD input of the inverter control circuit;

a no-load detection circuit coupled between the fourth output wire and the NLD input of the inverter control circuit;

wherein the inverter control circuit is operable to:

(a) provide an ignition period following initial application of electrical power to the ballast, wherein, regardless of the signals applied to the NLD and HVD inputs, the inverter switches are switched on and off in a complementary fashion for at least a first predetermined period of time;

(b) continue to provide complementary switching of the first and second inverter switches when the lamp is operating normally;

(c) terminate switching of the inverter switches in response to each of the following conditions: (i) failure of the lamp to ignite and operate normally within the ignition period; (ii) removal of the lamp; (iii) failure of the lamp to conduct current in a substantially normal fashion; and (iv) opening of at least one filament of the lamp; and (d) provide a relamping period, wherein complementary switching of the inverter switches is: (i) automatically resumed for at least a second predetermined period of time following replacement of a defective or failed lamp with a new lamp; and (ii) terminated in response to failure of the new lamp to ignite and begin operating normally within the relamping period; and wherein the inverter control circuit further comprises a driver circuit coupled to the first and second drive outputs, the driver circuit having a shutdown input, wherein the driver circuit is operable to provide complementary switching of the inverter switches when a logic "0" is applied to the shutdown input, and to terminate switching of the inverter switches when a logic "1" is applied to the shutdown input.

2. The electronic ballast of claim 1, wherein the inverter control circuit further comprises:

an internal reference source for providing a reference voltage;

a first comparator having a non-inverting input coupled to the HVD input, an inverting input coupled to the internal reference source, and an HVD output, the first comparator being operable to provide at the HVD output:

(i) a logic "1" when the voltage at the HVD input exceeds the reference voltage; and (ii) a logic "0" when the voltage at the HVD input is less than the reference voltage;

a second comparator having an inverting input coupled to the NLD input, a non-inverting input coupled to the internal reference source, and an NLD output, the no-load comparator being operable to provide at the NLD output:

(i) a logic "0" when the voltage at the NLD input exceeds the reference voltage; and (ii) a logic "1" when the voltage at the NLD input is less than the reference voltage.

3. The electronic ballast of claim 2, wherein the inverter control circuit further comprises a protection logic circuit operable to receive the HVD and NLD outputs from the first and second comparators and to provide a shutdown signal to the shutdown input of the driver circuit, wherein:

(a) the shutdown signal is a logic "0" in response to each of the following conditions:

(i) during the ignition period following initial application of power to the ballast;

(ii) when the HVD output is a logic "0" and the NLD output is a logic "0"; and (iii) when the NLD output is a logic "1" and the HVD output changes from a logic "0" to a logic "1"; and (b) the shutdown signal is a logic "1" in response to each of the following conditions:

(i) when the HVD output is a logic "1"; and (ii) when the NLD output is a logic "1" and the HVD output is not changing from a logic "0" to a logic "1".

4. The electronic ballast of claim 3, wherein the reference voltage provided by the internal reference source is adjusted in dependence on the shutdown signal, wherein the reference voltage is at a first level when the shutdown signal is a logic "0", and at a second level when the shutdown signal is a logic "1", the second level being less than the first level.

5. The electronic ballast of claim 1, wherein the inverter control circuit is implemented as a single integrated circuit.

6. The electronic ballast of claim 1, wherein the high-voltage detection circuit is operable:

(a) to provide a logic "1" at the HVD input of the inverter control circuit in response to failure of the lamp to conduct current in a substantially normal fashion while both lamp filaments are intact; and (b) to provide a logic "0" at the HVD input of the inverter control circuit in response to each of the following conditions:

(i) the lamp conducting current in a substantially normal fashion;

(ii) removal of the lamp; and (iii) at least one lamp filament being open.

7. The electronic ballast of claim 1, wherein the high-voltage detection circuit comprises:

a first resistor coupled between the second output wire and a second node;

a second resistor coupled between the second node and a third node;

a third resistor coupled between the third node and the circuit ground node;

a first diode having an anode coupled to the third node and a cathode coupled to the HVD input of the inverter control circuit;

a first capacitor coupled between the HVD input and the circuit ground node; and a fourth resistor coupled between the HVD input and the circuit ground node.

8. The electronic ballast of claim 7, wherein the high-voltage detection circuit further comprises:

a second diode having a cathode coupled to the second node and an anode coupled to a fourth node;

a second capacitor coupled between the fourth node and the circuit ground node;

an electronic switch having an emitter lead coupled to the DC supply input of the inverter control circuit, a collector lead, and a base lead;

a fifth resistor coupled between the emitter lead and the base lead of the electronic switch;

a first zener diode having an anode coupled to the fourth node and a cathode coupled to the base lead of the electronic switch; and a sixth resistor coupled between the collector lead of the electronic switch and the HVD input of the inverter control circuit.

9. The electronic ballast of claim 8, wherein the electronic switch comprises a PNP-type bipolar junction transistor.

10. The electronic ballast of claim 1, wherein the no-load detection circuit is operable:

(a) to provide a logic "1" at the NLD input of the inverter control circuit in response to both lamp filaments being intact; and (b) to provide a logic "0" at the NLD input of the inverter control circuit in response to each of the following conditions:

(i) removal of the lamp; and (ii) at least one lamp filament being open.

11. The electronic ballast of claim 1, wherein the no-load detection circuit comprises:

a seventh resistor coupled between the fourth output wire and the circuit ground node;

a third diode having an anode coupled to the fourth output wire and a cathode coupled to the NLD input of the inverter control circuit;

a third capacitor coupled between the NLD input and the circuit ground node; and an eighth resistor coupled between the NLD input and the circuit ground node.

12. The electronic ballast of claim 11, wherein the no-load detection circuit further comprises a fourth diode having a cathode coupled to the fourth output wire and an anode coupled to the circuit ground node.

13. The electronic ballast of claim 1, wherein the bootstrap circuit comprises:

a fourth capacitor coupled between the inverter output terminal and a fifth node;

a second zener diode having a cathode coupled to the fifth node and an anode coupled to the circuit ground node; and a fifth diode having an anode coupled to the fifth node and a cathode coupled to the DC supply input of the inverter control circuit.

14. The electronic ballast of claim 1, wherein the AC-to-DC converter comprises:

a full-wave rectifier circuit coupled between the input and output connections of the AC-to-DC converter; and a bulk capacitor coupled across the output connections of the AC-to-DC converter.

15. The electronic ballast of claim 14, wherein the startup circuit comprises:

a pull-down resistor coupled between the DC supply input of the inverter control circuit and one of the output connections of the AC-to-DC converter; and a filtering capacitor coupled between the DC supply input and the circuit ground node.

16. An electronic ballast for powering at least two gas discharge lamps, comprising:

an AC-to-DC converter having a pair of input connections adapted to receive a source of alternating current, and a pair of output connections;

an inverter, comprising:

first and second input terminals coupled to the output connections of the AC-to-DC converter, wherein the second input terminal is coupled to a circuit ground node;

an inverter output terminal;

a first inverter switch coupled between the first input terminal and the inverter output terminal;

a second inverter switch coupled between the inverter output terminal and the circuit ground node;

an inverter control circuit, comprising:

a DC supply input;

a first drive output coupled to the first inverter switch;

a second drive output coupled to the second inverter switch;

a high-voltage detect (HVD) input; and a no-load detect (NLD) input;

a startup circuit coupled between the AC-to-DC converter and the DC supply input of the inverter control circuit, the startup circuit being operable to provide power for initiating operation of the inverter control circuit; and a bootstrap circuit coupled between the first node and the DC supply input of the inverter control circuit, the bootstrap circuit being operable to provide steady-state operating power to the inverter control circuit;

an output circuit, comprising:

a first set of output wires comprising first, second, third, and fourth output wires adapted to being coupled to a first gas discharge lamp, wherein the first output wire is coupleable to the second output wire through a first filament of the first lamp, and the third output wire is coupleable to the fourth output wire through a second filament of the first lamp;

a second set of output wires comprising fifth, sixth, seventh, and eighth output wires adapted to being coupled to a second gas discharge lamp, wherein the fifth output wire is coupleable to the sixth output wire through a first filament of the second lamp, and the seventh output wire is coupleable to the eighth output wire through a second filament of the second lamp, the eighth output wire being coupled to the fourth output wire;

a DC blocking capacitor coupled between the inverter output terminal and a first node;

a DC path resistor coupled between the first input terminal and the first node;

a first resonant inductor coupled between the first node and the first output wire;

a second resonant inductor coupled between the first node and the fifth output wire;

a first resonant capacitor coupled between the second and third output wires; and a second resonant capacitor coupled between the sixth and seventh output wires;

a high-voltage detection circuit coupled between the HVD input of the inverter control circuit and at least the second and sixth output wires;

a no-load detection circuit coupled between the eighth output wire and the NLD input of the inverter control circuit;

wherein the inverter control circuit is operable to:

(a) provide an ignition period following initial application of electrical power to the ballast, wherein, regardless of the signals applied to the NLD and HVD inputs, the inverter switches are switched on and off in a complementary fashion for at least a first predetermined period of time;

(b) continue to provide complementary switching of the inverter switches as long as at least one operational lamp is present with both of its filaments intact and each of the failed lamps has at least one open filament;

(c) terminate switching of the inverter switches in response to each of the following conditions: (i) all of the lamps failing to ignite and operate normally within the ignition period; (ii) removal of all of the lamps; (iii) at least one of the lamps conducting current in a substantially abnormal fashion; (iv) all of the lamps having at least one open filament; and (d) provide a relamping period, wherein complementary switching of the inverter switches is automatically resumed for at least a second predetermined period of time following replacement of a defective or failed lamp with a new lamp; and wherein the inverter control circuit further comprises a driver circuit coupled to the first and second drive outputs, the driver circuit having a shutdown input, wherein the driver circuit is operable to provide complementary switching of the inverter switches when a logic "0" is applied to the shutdown input, and to terminate switching of the inverter switches when a logic "1" is applied to the shutdown input.

17. The electronic ballast of claim 16, wherein the inverter control circuit further comprises:

an internal reference source for providing a reference voltage;

a first comparator having a non-inverting input coupled to the HVD input, an inverting input coupled to the internal reference source, and an HVD output, the first comparator being operable to provide at the HVD output:

(i) a logic "1" when the voltage at the HVD input exceeds the reference voltage; and (ii) a logic "0" when the voltage at the HVD input is less than the reference voltage;

a second comparator having an inverting input coupled to the NLD input, a non-inverting input coupled to the internal reference source, and an NLD output, the no-load comparator being operable to provide at the NLD output:

(i) a logic "0" when the voltage at the NLD input exceeds the reference voltage; and (ii) a logic "1" when the voltage at the NLD input is less than the reference voltage.

18. The electronic ballast of claim 17, wherein the inverter control circuit further comprises a protection logic circuit operable to receive the HVD and NLD outputs from the first and second comparators and to provide a shutdown signal to the shutdown input of the driver circuit, wherein:

(a) the shutdown signal is a logic "0" in response to each of the following conditions:

(i) during the ignition period following initial application of power to the ballast;

(ii) the HVD output is a logic "0" and the NLD output is a logic "0"; and (iii) the HVD output changing from a logic "0" to a logic "1" while the NLD output is a logic "1"; and (b) the shutdown signal is a logic "1" in response to each of the following conditions:

(i) the HVD output is a logic "1"; and (ii) the NLD output is a logic "1" and the HVD output is not changing from a logic "0" to a logic "1".

19. The electronic ballast of claim 18, wherein the reference voltage provided by the internal reference source is adjusted in dependence on the shutdown signal, wherein the reference voltage is at a first level when the shutdown signal is a logic "0", and at a second level when the shutdown signal is a logic "1", the second level being less than the first level.

20. The electronic ballast of claim 16, wherein the inverter control circuit is implemented as a single integrated circuit.

21. The electronic ballast of claim 16, wherein the high-voltage detection circuit is operable:

(a) to provide a logic "1" at the HVD input of the inverter control circuit in response to failure of at least one of the lamps to conduct current in a substantially normal fashion while both of its lamp filaments are intact; and (b) to provide a logic "0" at the HVD input of the inverter control circuit in response to each of the following conditions:

(i) all of the lamps conducting current in a substantially normal fashion;

(ii) removal of all lamps;

(iii) each lamp having at least one open filament; and (iv) each of the failed lamps having at least one open filament.

22. The electronic ballast of claim 16, wherein the high-voltage detection circuit comprises:

a first resistor coupled between the second output wire and a second node;

a ninth resistor coupled between the sixth output wire and the second node;

a second resistor coupled between the second node and a third node;

a third resistor coupled between the third node and the circuit ground node;

a first diode having an anode coupled to the third node and a cathode coupled to the HVD input of the inverter control circuit;

a first capacitor coupled between the HVD input and the circuit ground node; and a fourth resistor coupled between the HVD input and the circuit ground node.

23. The electronic ballast of claim 22, wherein the high-voltage detection circuit further comprises:

a second diode having a cathode coupled to the second node and an anode coupled to a fourth node;

a second capacitor coupled between the fourth node and the circuit ground node;

an electronic switch having an emitter lead coupled to the DC supply input of the inverter control circuit, a collector lead, and a base lead;

a fifth resistor coupled between the emitter lead and the base lead of the electronic switch;

a first zener diode having an anode coupled to the fourth node and a cathode coupled to the base lead of the electronic switch; and a sixth resistor coupled between the collector lead of the electronic switch and the HVD input of the inverter control circuit.

24. The electronic ballast of claim 23, wherein the electronic switch comprises a PNP-type bipolar junction transistor.

25. The electronic ballast of claim 16, wherein the no-load detection circuit is operable:

(a) to provide a logic "1" at the NLD input of the inverter control circuit in response to at least one of the lamps having both filaments intact; and (b) to provide a logic "0" at the NLD input of the inverter control circuit in response to each of the following conditions:

(i) removal of all lamps; and (ii) each lamp having at least one open filament.

26. The electronic ballast of claim 16, wherein the no-load detection circuit comprises:

a seventh resistor coupled between the fourth output wire and the circuit ground node;

a third diode having an anode coupled to the fourth output wire and a cathode coupled to the NLD input of the inverter control circuit;

a third capacitor coupled between the NLD input and the circuit ground node; and an eighth resistor coupled between the NLD input and the circuit ground node.

27. The electronic ballast of claim 26, wherein the no-load detection circuit further comprises a fourth diode having a cathode coupled to the fourth output wire and an anode coupled to the circuit ground node.

28. The electronic ballast of claim 16, wherein the bootstrap circuit comprises:

a fourth capacitor coupled between the inverter output terminal and a fifth node;

a second zener diode having a cathode coupled to the fifth node and an anode coupled to the circuit ground node; and a fifth diode having an anode coupled to the fifth node and a cathode coupled to the DC supply input of the inverter control circuit.

29. The electronic ballast of claim 16, wherein the AC-to-DC converter comprises:

a full-wave rectifier circuit coupled between the input and output connections of the AC-to-DC converter; and a bulk capacitor coupled across the output connections of the AC-to-DC converter.

30. The electronic ballast of claim 29, wherein the startup circuit comprises:

a pull-down resistor coupled between the DC supply input of the inverter control circuit and one of the output connections of the AC-to-DC converter; and a filtering capacitor coupled between the DC supply input and the circuit ground node.

31. An electronic ballast for powering at least two fluorescent lamps, comprising:

an AC-to-DC converter having a pair of input connections adapted to receive a source of alternating current, and a pair of output connections;

an inverter, comprising:

first and second input terminals coupled to the output connections of the AC-to-DC converter, wherein the second input terminal is coupled to a circuit ground node;

an inverter output terminal;

a first inverter switch coupled between the first input terminal and the inverter output terminal;

a second inverter switch coupled between the inverter output terminal and the circuit ground node;

an inverter control circuit, comprising:

a DC supply input;

a first drive output coupled to the first inverter switch;

a second drive output coupled to the second inverter switch;

a high-voltage detect (HVD) input; and a no-load detect (NLD) input;

a startup circuit coupled between the AC-to-DC converter and the DC supply input of the inverter control circuit, the startup circuit being operable to provide power for initiating operation of the inverter control circuit; and a bootstrap circuit coupled between the first node and the DC supply input of the inverter control circuit, the bootstrap circuit being operable to provide steady-state operating power to the inverter control circuit;

an output circuit, comprising:

a first set of output wires comprising first, second, third, and fourth output wires adapted to being coupled to a first fluorescent lamp, wherein the first output wire is coupleable to the second output wire through a first filament of the first lamp, and the third output wire is coupleable to the fourth output wire through a second filament of the first lamp;

a second set of output wires comprising fifth, sixth, seventh, and eighth output wires adapted to being coupled to a second fluorescent lamp, wherein the fifth output wire is coupleable to the sixth output wire through a first filament of the second lamp, and the seventh output wire is coupleable to the eighth output wire through a second filament of the second lamp, the eighth output wire being coupled to the fourth output wire;

a DC blocking capacitor coupled between the inverter output terminal and a first node;

a DC path resistor coupled between the first input terminal of the inverter and the first node;

a first resonant inductor coupled between the first node and the first output wire;

a second resonant inductor coupled between the first node and the fifth output wire;

a first resonant capacitor coupled between the second and third output wires; and a second resonant capacitor coupled between the sixth and seventh output wires;

a high-voltage detection circuit coupled between the HVD input of the inverter control circuit and at least the second and sixth output wires;

a no-load detection circuit coupled between the eighth output wire and the NLD input of the inverter control circuit; and wherein the inverter control circuit further comprises:

a driver circuit coupled to the first and second drive outputs, the driver circuit having a shutdown input, wherein the driver circuit is operable to provide complementary switching of the inverter switches when a logic "0" is applied to the shutdown input, and to terminate switching of the inverter switches when a logic "1" is applied to the shutdown input;

an internal reference source for providing a reference voltage that is adjusted in dependence on the shutdown signal, wherein the reference voltage is at a first level when the shutdown signal is a logic "0", and at a second level when the shutdown signal is a logic "1", the second level being less than the first level;

a first comparator having a non-inverting input coupled to the HVD input, an inverting input coupled to the internal reference source, and an HVD output;

a second comparator having an inverting input coupled to the NLD input, a non-inverting input coupled to the internal reference source, and an NLD output; and a protection logic circuit operable to receive the HVD and NLD outputs from the first and second comparators and to provide a shutdown signal to the shutdown input of the driver circuit, wherein:

(a) the shutdown signal is a logic "0" in response to each of the following conditions: (i) during an ignition period following initial application of power to the ballast; (ii) at least one operational lamp is present with both of its filaments intact, and each of the failed lamps has at least one open filament; and (iii) during a relamping period following replacement of a defective or failed lamp with a new lamp; and (b) the shutdown signal is a logic "1" in response to each of the following conditions: (i) all of the lamps failing to ignite and operate normally within the ignition period; (ii) removal of all of the lamps; (iii) at least one of the lamps conducting current in a substantially abnormal fashion; and (iv) each of the lamps having at least one open filament.

* * * * *